US011702767B2

(12) United States Patent
Rawlins et al.

(10) Patent No.: US 11,702,767 B2
(45) Date of Patent: Jul. 18, 2023

(54) NOZZLE AND A METHOD FOR THE PRODUCTION OF MICRO AND NANOFIBER NONWOVEN MATS

(71) Applicants: John Rawlins, Kitchener (CA); Jin Hee Kang, Yongin (KR)

(72) Inventors: John Rawlins, Kitchener (CA); Jin Hee Kang, Yongin (KR)

( * ) Notice: Subject to any disclaimer, the term of this patent is extended or adjusted under 35 U.S.C. 154(b) by 0 days.

(21) Appl. No.: 15/977,123

(22) Filed: May 11, 2018

(65) Prior Publication Data

US 2019/0352801 A1 Nov. 21, 2019

Related U.S. Application Data

(60) Provisional application No. 62/505,188, filed on May 12, 2017.

(51) Int. Cl.

| | |
|---|---|
| ***D01D 4/02*** | (2006.01) |
| ***D01D 5/26*** | (2006.01) |
| ***D04H 1/732*** | (2012.01) |

(52) U.S. Cl.

CPC ..... *D01D 4/025* (2013.01); *D01D 5/26* (2013.01); *D04H 1/732* (2013.01)

(58) Field of Classification Search

CPC ..... D01D 4/025; D01D 5/26; D04H 1/732; D04H 1/43835; D04H 1/43838; D04H 1/56; B29C 70/382; B29C 48/05; B29K 2105/122; B29K 2105/124; B01J 20/28007

See application file for complete search history.

(56) References Cited

U.S. PATENT DOCUMENTS

2009/0093585 A1* 4/2009 Smith ..... B32B 5/022 524/507
2011/0242310 A1* 10/2011 Beebe, Jr. ..... G06K 9/00577 348/88
2012/0149273 A1* 6/2012 Moore ..... D04H 3/016 28/104
2015/0190543 A1* 7/2015 Marshall ..... A61L 15/425 424/443

OTHER PUBLICATIONS

D. A. Saville, "Electrohydrodynamics: The Taylor-Melcher Leaky Dielectric Model," Annual Review of Fluid Mechanic, vol. 1, pp. 111-146, 1997.

(Continued)

*Primary Examiner* — Stella K Yi

(74) *Attorney, Agent, or Firm* — Nasser Ashgriz; UIPatent Inc.

(57) ABSTRACT

The present invention is a novel gas assisted nozzle and a method for micro and nanofiber production. In this composite nozzle, a high velocity gas stream is introduced through a core protruding orifice, while a liquid is introduced via at least one satellite orifice, external to the core orifice. The liquid flow is picked-up and accelerated (blown) by the gas stream from the tip of the protruding gas nozzle. This avoids passing the high velocity gas over the surface of the slow flowing liquid and achieves the acceleration of the liquid flow on its approach to being picked-up by the gas stream. Proper control of the gas and the polymer liquid flow results in fine liquid blowing and formation of micro and nanofibers.

7 Claims, 23 Drawing Sheets

(56) References Cited

OTHER PUBLICATIONS

A. M. Gañán-Calvo, "Revision of capillary cone-jet physics: Electrospray and flow focusing," Physical Review, vol. 79, p. 066305, 2009.
Herrada et al., , "Numerical simulation of electrospray in the cone-jet mode," Phys. Rev. , vol. E 86, 2012.
Benavides et al., "Nanofibers from Scalable Gas Jet Process," ACS Macro Lett, vol. 1, No. 8, pp. 1032-1036, 2012.I.
Tang D, Zhuang X, Zhang C, Li X, "Generation of nanofibers via electrostatic-Induction-assisted solution blow spinning," Journal of Applied Polymer Science , vol. 132, No. 31.
Wang et al., "Electrospinning of polyacrylonitrile solution at elevated temperatures," Macromolecules, vol. 40, pp. 7973-7983, 2007.
Angammana CJ and Jayaram SH, "Analysis of the effects of solution conductivity on electrospinning process and fiber morphology," IEEE Transactions on Industry Applications, vo.
A. Ganan-Calvo, "On the general scaling theory for electrospraying," J. Fluid Mech., vol. 507, pp. 203-212, 2004.
BCC Research , "Nanofibers: Technologies and Developing Markets," 2007.
BCC Research, "Global Markets and Technologies for Nanofibers," 2016.
Grand View Research, "Nanofibers Market Size," 2016.
Luo C J, Stoyanov S D, Stride E, Pelan E , Edirisinghe M, "Electrospinning versus Fibre Production Methods: From Specifics to Technological Convergence," The Royal Society o.
R. R. Butin, J. P. Keller and J. W. Harding, "Non-Woven Mats by Melt Blowing". U.S. Pat. No. 3,849,241, Nov. 19, 1974.
Sinha-Ray S, Yarin A L, Pourdeyhimi B, "Meltblown fiber mats and their tensile strength.," Polymer, vol. 56, pp. 452-463, 2014.
Nayak R, Padhye R, Kyratzis I L, Truong Y B and Arnold L, "Recent advances in nanofibre fabrication techniques.," Textile Research Journal, vol. 82, No. 2, pp. 129-147, 2012.
Reneker D, Yarin A L, "Electrospinning jets and polymer nanofibers," Polymer, vol. 49, No. 10, pp. 2387-2425, 2008.
Teo W E, Inai R, Ramakrishna S, "Technological advances in electrospinning of nanofibers," Science and Technology of Advanced Materials, vol. 12, No. 1, 2011.
E. S. Medeiros, G. M. Glenn, A. P. Klamczynski, W. J. Orts and L. H. C. Mattoso, "Solution Blow Spinning". U.S. Pat. No. 8,641,960 B1, Feb. 4, 2014.
Sinha-Ray S, Yarin A L, Pourdeyhimi B, Theoretical and experimental investigation of the physical mechanisms responsible for polymer nanofiber formation in solution blowing.
Medeiros E S, Glenn G M, Klamczynski A P, Orts W J, Mattoso L H C, "Solution Blow Spinning: A New Method to Produce Micro- and Nanofibers from Polymer Solutions," Journal ofAp.
D. H. Reneker, "Process and Apparatus for the Production of Nanofibers". U.S. Pat. No. 6,382,526 B1, May 7, 2002.
Paquier A, Moisy F, and Rabaud M, "Surface deformations and wave generation by wind blowing over a viscous liquid," Physics of Fluids, vol. 27, p. 122103, 2015.
Schindelin J, Rueden C T, Hiner M, Eliceiri K, "The ImageJ Ecosystem: An Open Platform for Biomedical Image Analysis," Molecular Reproduction & Development, vol. 82, p. 518-5.
Helgeson et al., "Theory and kinematic measurements of the mechanics of stable electrospun polymer jets," Polymer, vol. 49, No. 12, pp. 2924-2936, 2008.
J. L. Plawsky, "Transport Phenomena Fundamentals, Third Edition," CRC Press, 2014, p. 34.
D. J. Anderson, "Governing Equations of Fluid Dynamics," in Computational Fluid Dynamics, Berlin, Springer, 2009, pp. 15-51.
Hoeve W V, Gekle S, Snoeijer J H, Versluis, Brenner M P, Lohse D, "Breakup of diminutive Rayleigh jets," Physics of Fluids, vol. 22, p. 122003, 2010.
Mishra P, Singh D, and Mishra I M, "Momentum transfer to Newtonian and non-Newtonian fluids flowing through packed and fluidized beds," Chemical Engineering Science, vol. 30.

* cited by examiner 40 psi 50 psi 60 psi

NOZZLE AND A METHOD FOR THE PRODUCTION OF MICRO AND NANOFIBER NONWOVEN MATS

RELATED APPLICATIONS

The present application claims the priority date of the provisional patent application No. 62/505,188 filed on May 12, 2017.

FIELD OF THE INVENTION

The present invention relates in general to a method for producing liquid jets, and in specific to a nozzle that generates micro and nanofiber mats.

BACKGROUND OF THE INVENTION

The global nanofiber market has grown steadily due to new and expanding applications, such as tissue engineering, drug delivery systems, medical implant devices, water and air filtration, and protective clothing. In order to fully realize the benefits of nanofiber technologies, the nanofiber manufacturing process has to be cost effective. The economics and production levels of the current nanofiber production techniques, have relegated current nanofiber uses mainly to niche-markets, making the scaling up of production a pressing issue in ushering in the widespread commercialization of nanofiber products.

In contrast, Melt blowing is a highly commercialized technique that is used to produce microfiber nonwoven mats, because of its high production rates and its economic feasibility. Melt blowing uses a heated, pressurized, air stream to accelerate a polymer melt, extruded from a die, into jets that eventually solidify and deposit forming fiber mats. The high velocity gas stream is delivered via the external portion of a concentric nozzle, while the melt is delivered via the internal portion of the concentric nozzle. The typical average dimension of melt-blown fibers is 2-10 μm. Production of nanofiber mats by melt blowing is highly dependent on extrusion die design, which are usually highly engineered. In general, to produce nanoscale fibers using melt blowing, the internal diameter of the melt delivering die nozzles must be decreased, increasing the number of nozzles per die area. Fibers with an average diameter of 300 nm were melt blown using an orifice with a diameter of 0.125 mm. The high operational pumping pressure needed to overcome the frictional losses associated with the numerous fine nozzles, increases operation costs and is a drawback to producing nanofibers using this method.

Electrospinning is another method of producing nanofibers, because of its simplicity and versatility. In a single needle electrospinning, a repulsive electrostatic force is created at the tip of a capillary tube. This electrostatic force is used to accelerate a drop of polymer solution suspended at the tip into a jet. The fine jets and turbulent flow created induces rapid evaporation of the solution solvent and solidification of polymer fibers. The inherent productivity, however, of the single needle electrospinning method is typically low, less than 1 g/hr. To increase productivity of electrospinning, methods have been devised that produce multiple jets from a single needle, multiple jets from multiple needles, and multiple jets from needleless systems. Multiple needle systems faces challenges, which stems from the large amount of needles that are needed to attain acceptable production levels, while needleless systems challenges are derived from the relatively large polymer solution surface area used in these methods.

Table 1, summarizes the distinct challenges experienced while scaling up the production of commonly used nanofiber production methods.

TABLE 1

Scaling up challenges of different nanofiber produciton methods.

| Process | Scaling up Challenges |
|---|---|
| Melt-blowing | Highly engineered ultrafine extrusion die orifices required |
| Electro-spinning (Multi-Needle) | Numerous needles needed because of the low needle productivity<br>Electrical field interference of adjacent needles<br>Difficult to clean large number of nozzles<br>Difficult to maintain a uniform solution feed rate through each needle |
| Electro-spinning (Needle-less) | Large free surface leads to concentration consistency problems<br>Require relatively high voltages in operation |

Increasing the production levels of a single needle would eliminate the need for the large number of needles as used in the multi-needle electrospinning systems, and also would eliminate the use of large free surfaces as used in needleless electrospinning systems. By increasing the yield of a single needle system, the challenges faced by electrospinning multiple needle systems and needleless systems are addressed.

Solution blow spinning is another technique that combines elements of electrospinning and melt blowing process. Solution blowing improves on the single needle electrospinning productivity, employing solution feed rates on average of 5 to 10 ml/hr. Like solution blow spinning, the nanofiber spinning technique introduced in this work combines the use of polymer solution with the use of a high velocity air stream.

SUMMARY OF THE INVENTION

A novel gas assisted jetting process is disclosed to generate polymer base nanofiber. A composite nozzle and a method for forming micro and nanofibers from a polymer solution or a polymer melt is disclosed. The composite nozzle comprises of at least one core orifice having a core-tip, and an at least one satellite orifice, external to the core orifice, having a satellite-tip, wherein the core-tip extends outwardly beyond the satellite-tip forming a protrusion distance. A fiber forming liquid at a relatively low liquid flow rate is supplied to the satellite orifice or orifices to form a liquid capillary surface between the satellite-tip and the core-tip. And, a gas stream at a gas stream flow rate or gas pressure is supplied through the core orifice. The liquid and gas flow rate is adjusted to create a plurality of liquid jets at the liquid capillary surface. These plurality of liquid jets are picked-up and accelerated by the gas stream to form micro and nano size fibers.

In one embodiment, a high velocity gas stream is introduced through a central nozzle, which protrudes from the exit of the surrounding liquid polymer nozzle. The orientation of the nozzles allows the high velocity gas to work against surface tension, reducing the cross-sectional area of the polymer flow, immediately at the cross-section where the air and the polymer first interacts. In this manner the process produces a stable liquid cone structure, where the liquid flow is continuously accelerated along its approach to the site where the high velocity air initially interacts with the polymer. The process results in multiple jets, initiated at high Reynolds numbers. Higher Reynolds numbers, translates into finer jets of higher average velocities, carrying higher volumetric flow rates. Finer initial jet radius, results in increased specific surface area, allowing for greater initial acceleration of the jets via surface shearing. High fiber production rates are attained by the creation of multiple fiber jets and through the elevated volumetric rates at which the process is able to operate. The present fine liquid blowing method is able to produce a variety of fibers from polymeric solutions such as poly (vinyl alcohol) at a solution feed rate of up to 135 g/hr polymer flow, with fibers of diameters ranging from 96 nm to 430 nm. The flow rates can be changed to produce a wider range of fiber diameters (10 nm to 10 microns). Over the test range polymer fluid flow rate does not show any influence on the resulting fiber diameter. The process also produces polypropylene mats at a mass flow rate of 500 g/hr, containing more than 90% fiber having diameters less than 1000 nm. Both solution and melt based liquid polymers are used to create nanofiber mats.

The objective is to produce sub-micron nonwoven fiber mats from a single nozzle at high production rates. To achieve this goal, the technique is designed to create polymer jets of high initial jetting velocities by stably accelerating the polymer flow before jetting and through the creation of multiple jets.

The present nozzle and method can produce nano-size fibers by adjusting the operating parameters of solution feed rate and supply gas pressure. The present method allows for a scaling where fine fiber diameter can be produce from large nozzles at high production rates. This scaling arises from the ability to generate high initial liquid jetting velocities.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

DETAILED DESCRIPTION OF PREFERRED EMBODIMENTS

The figures are not intended to be exhaustive or to limit the present invention to the precise form disclosed. It should be understood that the invention can be practiced with modification and alteration, and that the disclosed technology be limited only by the claims and equivalents thereof.

The device disclosed herein, in accordance with one or more various embodiments, is described in detail with reference to the following figures. The drawings are provided for purposes of illustration only and merely depict typical or example embodiments of the disclosed device. These drawings are provided to facilitate the reader's understanding of the disclosed technology and shall not be considered limiting of the breadth, scope, or applicability thereof. It should be noted that for clarity and ease of illustration these drawings are not necessarily made to scale.

Figure 1:
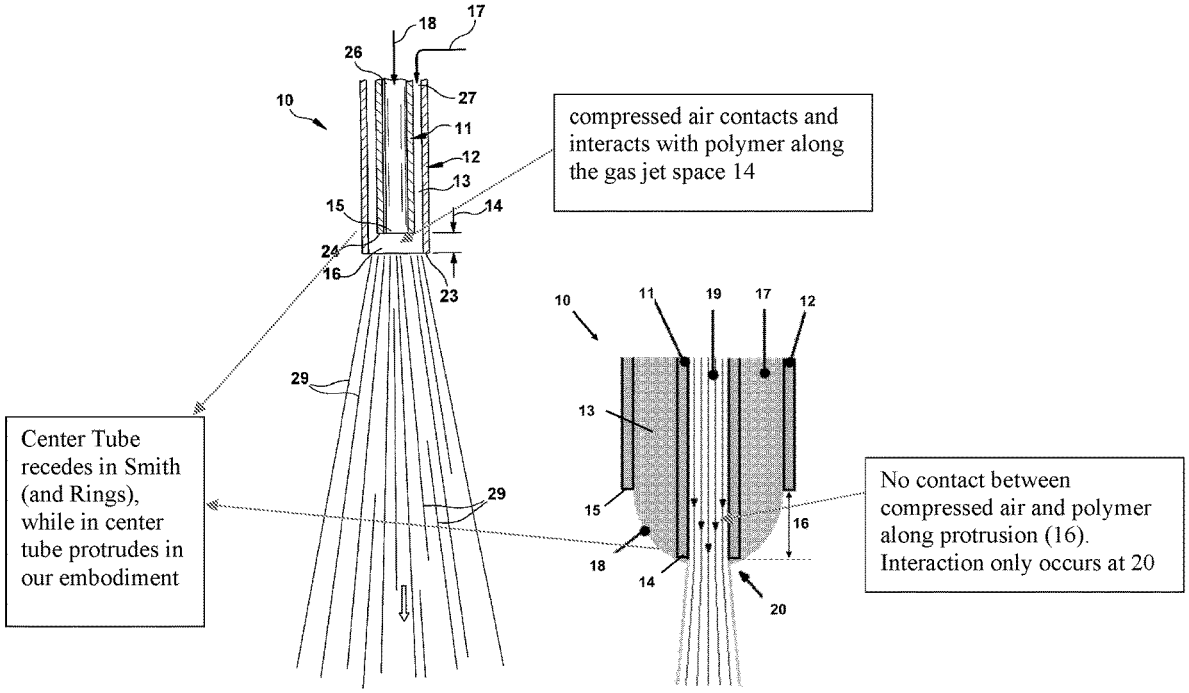
FIG. 1 is a depiction of the cross section of the coaxial needle and fluid drop suspended at its tip.

A novel gas assisted nozzle is disclosed here. FIG. 1 shows the cross section of the coaxial flow nozzle 10, which comprises of an inner needle or core orifice 11 and an outer coaxial needle or satellite orifice 12. The coaxial needles form an annular region (an annulus) 13. The tip of the inner needle or core-tip 14 protrudes beyond the tip of the outer needle or satellite-tip 15. This results in a predefined protrusion distance 16 between the core-tip 14 and the satellite-tip 15. A liquid 17 is supplied at a controlled rate to the outer annular region 13. The liquid flow is such that the liquid is suspended at the tip of the nozzle 10, forming a capillary liquid-gas interface 18. A high velocity gas 19 is injected in the inner core 11. As the gas exits the nozzle, it shears the liquid from the capillary interface 18. This shearing process forms local jets of the liquid 20. Each of the jets are accelerated by the gas forming micro and nanofibers.

While this annular coaxial form is used to achieve the design goal of accelerating the liquid flow before the initiation of liquid jets occurs, other symmetrical and nonsymmetrical gas assisted nozzle designs, can be used to achieve the desired goal. Generally the nozzle is designed so that the satellite orifice intended to deliver the liquid flow is external to the core orifice carrying the high velocity gas. Then the core orifice intended to carry the high velocity gas should have a protrusion distance from all paired liquid carrying satellite orifices.

Figure 2:
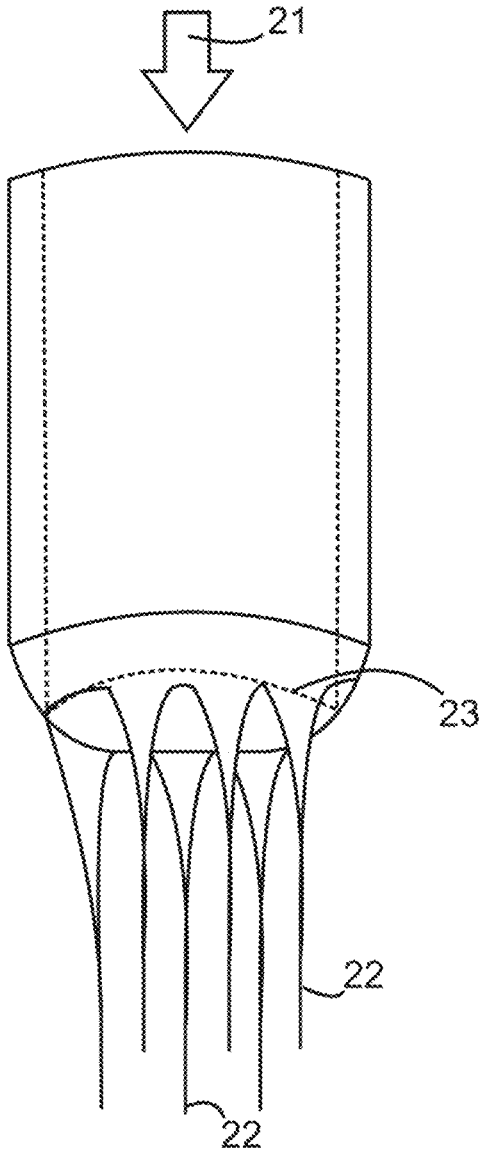
FIG. 2 depicts the jetting process from the liquid surfaces.

The presently disclosed fine liquid blowing is a novel method to produce sub-micron fibers and nonwoven fiber mats. FIG. 2 shows the liquid jets formed from the capillary interface. In this process, the high velocity gas stream 21 introduced through the central protruding nozzle, applies an accelerating force on the liquid polymer in an orientation that allows surface tension to be overcome, and the cross-sectional area of the polymer flow to be reduced, immediately at the site were the high velocity air initially contacts the liquid polymer 23. In the process the liquid flow average velocities increase on approach to the jetting sites 23, producing multiple jets 22 that are initiated at high velocities. High velocities and significant inertial forces allow for high volumetric flows with fine initial jetting radii. This, along with the numerous jetting sites created, combines to enable the blowing process to achieve high fiber production rates. By protruding the gas nozzle out of the nozzle carrying the liquid flow, fine liquid blowing avoids passing the high velocity gas over the surface of the slow flowing liquid. The shearing of a high velocity gas over a slow moving liquid creates unstable surface waves.

Finer initial jets are advantageous in fine fiber production. First of all, finer jets require less acceleration to reduce the radii to the desired fiber radius downstream. Then finer jets have higher specific surface area, and since shear force is proportional to surface area, then finer jets allow for higher specific shear force. Thus finer jets allow for greater acceleration. The way fine liquid blowing affects initial jet radius scaling, is analyzed here.

Figure 3:
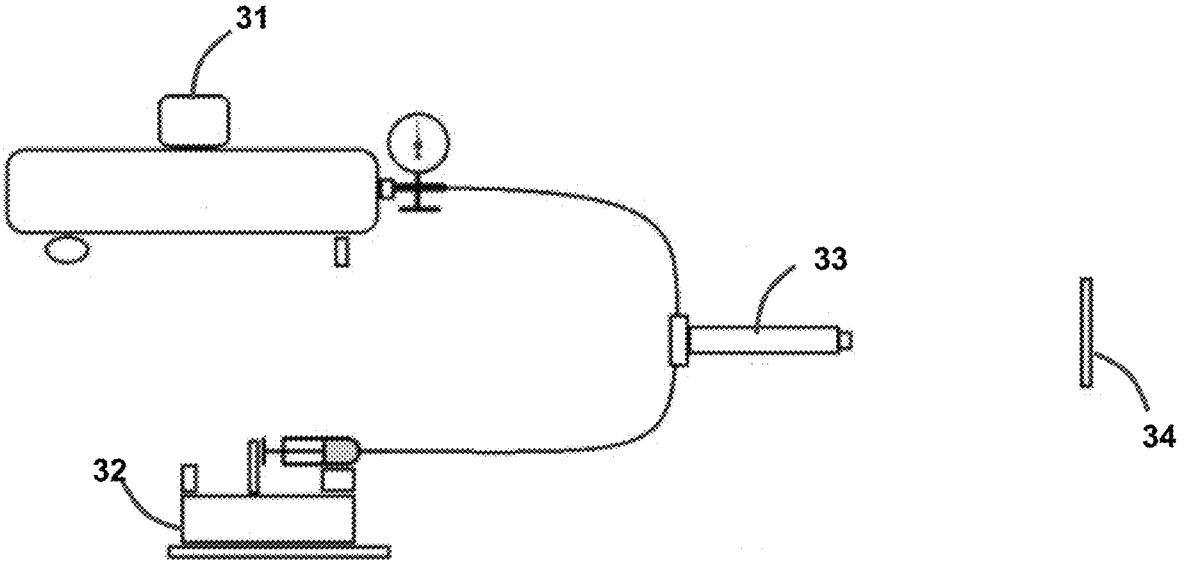
FIG. 3 shows the setup for generating nanofibers.

Test: A setup to generate nanofibers is shown in FIG. 3. The setup comprises of a compressor 31 (such as the Makita MAC5200 air compressor), with a pressure gauge and regulator to control the flow of compressed air leaving the device, a pump 32 (such as the New Era model NE-1000 syringe pump), and a coaxial needle 33. A stationary aluminum screen mesh 34 is used as the substrate to collect the created fiber mats. In one embodiment a syringe pump is used with a 60 ml BD syringe to generate a metered liquid polymer volumetric flow rate, which is supplied to the nozzle, made of a 14 gauge inner needle (ID=1.6 mm, OD=2.108 mm, wall thickness=0.254 mm) and a 10 gauge outer needle (ID=2.692 mm, OD=3.404 mm, wall thickness=0.356 mm).

A variety of nozzle sizes can be used. The core nozzle diameters can be in a range of 0.5 mm to 5 mm, whereas the concentric satellite nozzle diameters can be in a range of 0.7 mm to 10 mm. The annular gap width can be in the range of 0.1 mm to 4 mm. The protrusion distance can be in a range of 0.1 mm to 3 mm.

To generate the PVA nanofibers, a compressed air is generated by the compressor 31 and introduced into the core of the coaxial needle 33 at a constant pressure of 120 psi. Although air was used in this test, however, any other gas suitable for nanofiber production, such as Nitrogen, Argon, CO2, vapor of any other substance (such as steam, solvent vapor, chemical vapor), and/or aerosolized environment, can also be used. Simultaneously PVA polymer solution, of a concentration of 15% wt in water, is pumped into the adjacent outer shell of the coaxial needle 33, using the syringe pump 32 at 10 ml/min. An aluminum mesh substrate 34 is held at a distance of 60 cm downstream from the tip of the coaxial needle. Distances ranging between 25 and 150 cm can be appropriately used to collect fiber mats.

The process was used to produce poly (vinyl alcohol) nonwoven fiber mats at a solution feed rate of up to 900 ml/hr (135 g/hr polymer flow), with fibers of diameters ranging from 96 nm to 430 nm. A polymer by Aldrich brand Poly (vinyl alcohol) (PVA) (MW 89,000-98,000 99+% hydrolyzed), procured from Sigma-Aldrich Canada, was used. The solvent was deionized distilled water.

Figure 4:
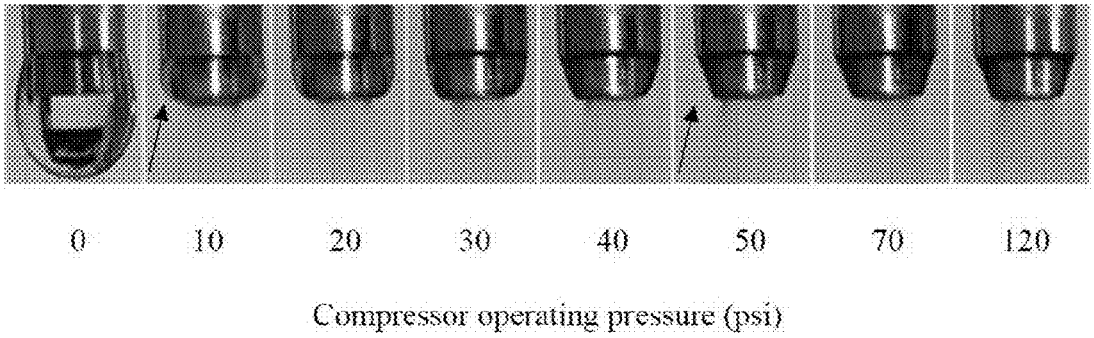
FIG. 4 shows the jetting behavior and evolution of the shape of water drop at the needle tip.
Figure 5:
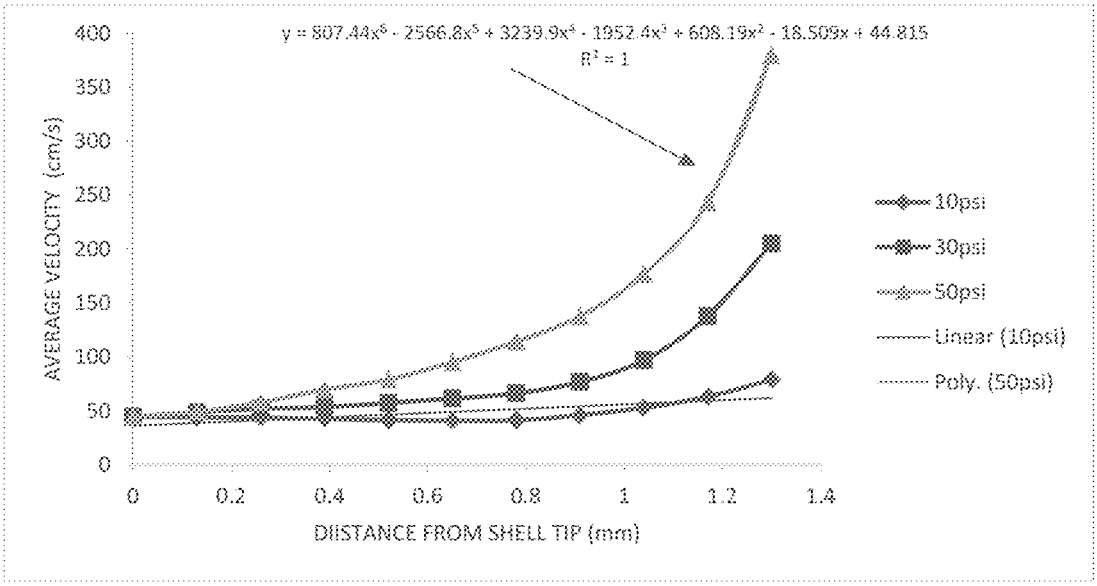
FIG. 5 shows a plot of the estimated average velocity along the drop at the tip of the shell.

FIG. 4 shows a series of pictures that illustrating the shape evolution of a water drop, fed at 900 ml/hr, as the operating compressor pressure is increased. The high velocity gas exerts a shear force on the liquid flow at the tip of the core needle. This interaction at the tip initiates a series of fine jets along the circumference of the core needle emanating from a stable liquid drop. FIG. 4 shows that as the operating pressure of the compressor is increased, from 0 psi to 120 psi, the drop becomes thinner at the tip. The conservation of mass dictates, that under steady conditions, the cross-sectional area perpendicular to the liquid flow is inversely proportional to the average velocity flowing through that area. At any constant liquid feed rate, thus, a thinner flow is hence reflective of a higher liquid velocity. The images in FIG. 4 were analyzed using the Image-J open software to determine the diameters of flow along the drop. The average velocities of the fluid flow at the tip is thus:

$$v_{average} = \frac{Q}{A_{cr-sec}}$$

where Q is liquid feed rate supplied by the polymer pump and $A_{cr-sec}$ is the visually measured annular cross sectional area of liquid flow along the nozzle tip. The average velocities of the fluid at the tip as derived from the cross sectional area of the flows are presented in FIG. 5. A function that closely predicts the trend of average velocity approaching the jetting point at different pressures are obtained. For instance, at an operating pressure of 50 psi, the average initial jet velocity of water supplied at 900 mL/hr at the jetting point (1.6 mm from shell tip) is predicted to be 14.4 m/s. This is significantly larger than the almost zero value that occurs in conventional technologies melt blowing and electrospinning.

Solution feed rate is an important parameter, in achieving a particular production rate of nonwoven fiber mats when spinning a solution. The relationship between solution feed rate and the production rate of nonwoven fiber mats in the process can be derived via mass balance analysis:

$$\dot{m} = Q\rho c\eta_p \quad (1)$$

where $\dot{m}$ is the fiber production rate, Q is the solution feed rate, ρ is the solution density, c is the polymer concentration in solution, and $\eta_p$ is the efficiency of the process. Assuming that the process is 100% efficient in producing fibers from the polymer liquid then production rate is simply the solution feed rate of the polymer by the density of the polymer solution and the mass concentration of the polymer in solution. Equation (1), highlights a fundamental challenge in attempting to increase the production rate of a single needle system; increasing the feed rate while maintaining small fiber area. The present design aims to achieve high average initial jetting velocities to achieve this objective.

Figure 6:
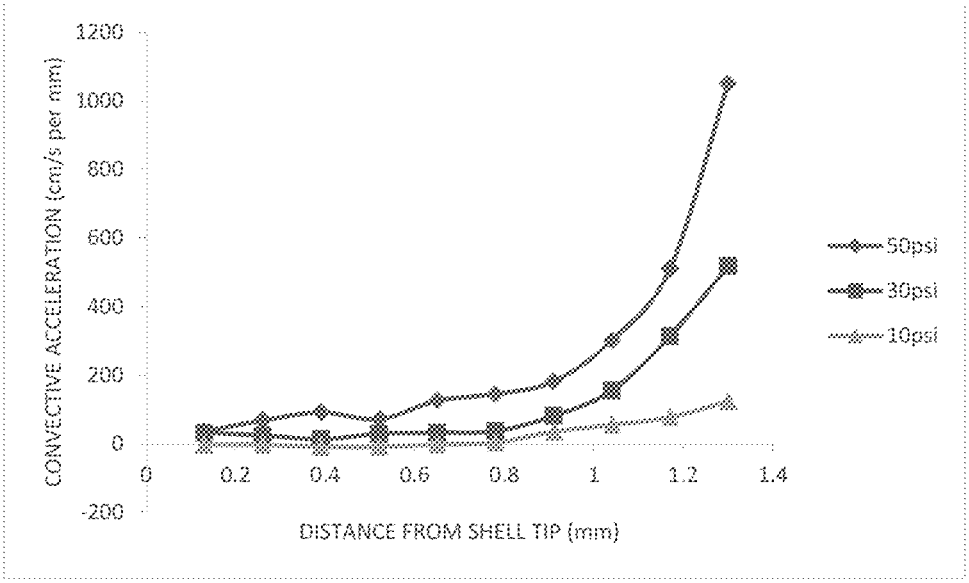
FIG. 6 shows a plot of the average convective acceleration along the drop at the tip of the shell.

The average convective acceleration is estimated by dividing the change in average velocity, from cross-section to cross-section, by the distance between the respective cross-sections. This result is then presented in FIG. 6, which illustrates that the acceleration of the liquid flow increases as the operating pressure of the compressor is increased. Also as the liquid flows approach the jetting sites at the exit of the air nozzle, their acceleration also increases. This illustrates that the influence of the accelerating force increases as the flow moves closer to the site where the accelerating force is initially applied and as the operational pressure is increased.

Figure 7:
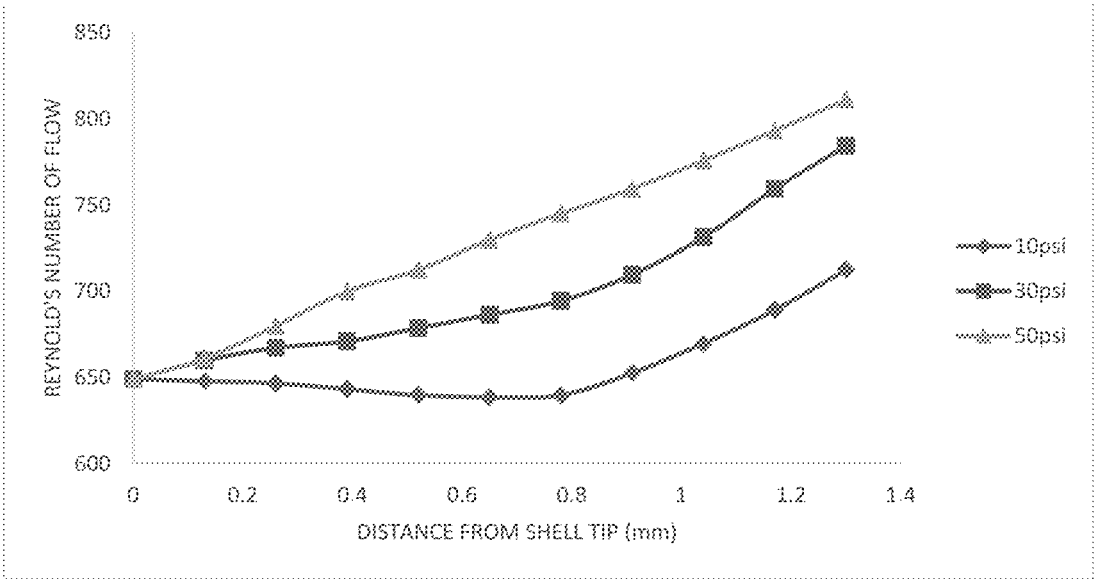
FIG. 7 shows the Reynolds number approaching the jetting sites.

The increase in velocities generate an increase in the inertial forces of the flows. As is shown in FIG. 7, the Reynolds number increases as the flow approaches the jetting sites and as the operating pressure is increase. This would indicate that as compared to viscous forces, inertial forces are becoming increasingly more significant as the jetting sites are approached and the operating pressure is increased. Reynolds number, Re, is defined as follows: $Re=\rho v_{average}(D_o-D_i)/\mu$, where $\rho$ is the liquid density, $v_{average}$ is the average liquid velocity, $D_o$ is the outer diameter of annular liquid flow, $D_i$ the inner diameter of annular liquid flow, and $\mu$ the dynamic viscosity of liquid.

Figure 8:
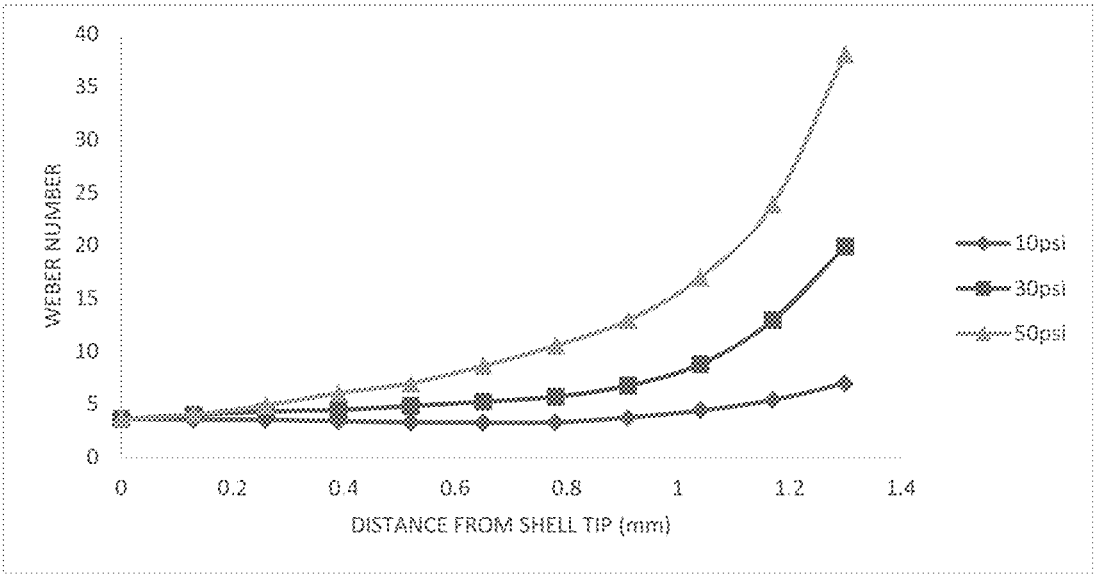
FIG. 8 shows the inferred Weber number if flow were to jet.

The inertial forces established within the liquid drop at the tip of the needle, initiated as a result of the transfer of momentum from the high velocity gas stream to the liquid, is observed to dominate gravitational forces, so that after the flow starts the needle can be held in any orientation in the gravitational field without impeding the jetting and with little change to the shape of the drop. Also, if the outer diameter minus the inner diameter ($D_o-D_i$) is consider to be the diameter of the jet formed, from FIG. 8, one can readily confirm the existence of water jets at the jetting site since the critical Weber number of 4, required for jetting, is surpassed before reaching the tip. Here the Weber number, We, is defined as follows:

$$We=\rho v_{average}^2(D_o-D_i)/\sigma.$$

In the present nozzle, the liquid flow rate is low, but it is sheared off by the gas flow. It is found that gas flow has to be a multiple factor of the minimum jetting velocity that can be obtained by setting the Weber number equal to 4. Therefore, for a coaxial nozzle having a annular width of $\delta=(D_o-D_i)$, the minimum gas flow velocity needed can be determined from the above equation as:

$$v_{gas,min}^2=\frac{\alpha^2\sigma We}{\rho(D_o-D_i)} \text{ or } v_{gas,min}=2\alpha\sqrt{\frac{\sigma}{\rho\delta}}$$

where $\alpha$ is an empirical factor that is experimentally determined for different liquids. For the present liquids it is in the order of 100.

Scaling of the Liquid Jets—The velocity profile for Newtonian liquids have been proven, by measurement and model, to be accurately represented by a parabolic function. Newton's Law of viscosity with boundary condition can be used in the integration of a parabolic function to obtain an expression for the average velocity across the velocity profile. This is given in equation 2.

$$v_{average}=v_o+\frac{\tau_A}{4\mu}R \tag{2}$$

where $v_o$ is the longitudinal velocity at jet center (velocity where radius is zero), $\tau_A$ the shear stress at jet surface, and R the radius of jet section.

As defined previously Reynolds number is a comparison of inertial forces and viscous forces. At low Reynolds numbers the average velocity is small, so that the core velocity approaches zero. The average velocity, is then purely a function of viscous forces. So from equation 2 we can model what happens as lower Reynolds numbers are approached: When $v_o\rightarrow 0$, then $$v_{average}\approx\frac{\tau_A}{4\mu}R \tag{2A}$$

On the other hand, at higher Reynolds numbers the average velocity becomes high, so that the core velocity approximates the average velocity. In this case inertial forces are dominant, while viscous forces are less significant. Equation 2 can be used to illustrate high Reynolds number: When $v_o\rightarrow\infty$, then $$v_{average}\approx v_o \tag{2B}$$

Figure 9:
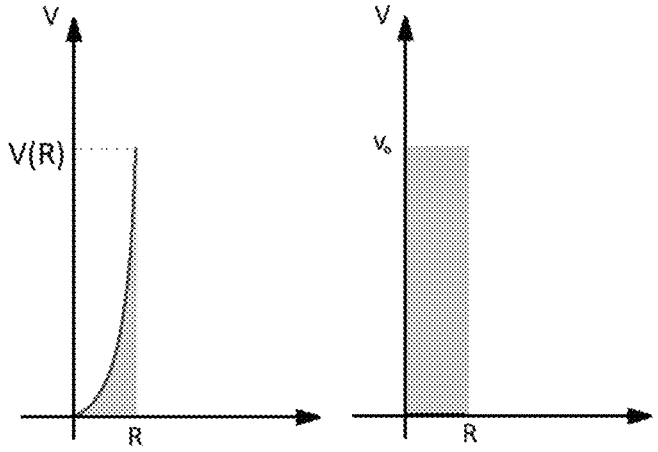
FIG. 9 show two graphical illustrations of the plot of velocity profile of cross sectional area of liquid jet.

This qualitative analysis also applies to Power Law Model, which can be used to accurately represent non-Newtonian solutions, like PVA water solutions, is employed. The only difference being the form of the function that most accurately represent the velocity profile of the fluid at low Reynolds numbers. This characteristic jet scaling is illustrated graphically in FIG. 9. Graphically, by considering the area under the curve, it can be recognized that increasing the core velocity ($v_o$) under high Reynolds number conditions (see FIG. 9(*b*)), is a more effective way to increase the average velocity of the flow, compared to just an increase of the liquid surface velocity (V(R)) under low Reynolds number conditions (see FIG. 9(*a*)). In the scope of fine fiber production, finer initial jets can be created at higher flow rates as the Reynolds number is increased.

Figure 10A:
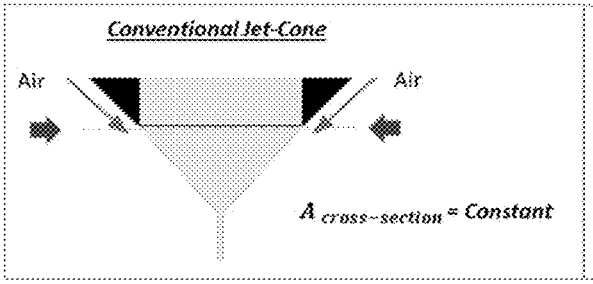
FIG. 10A shows a depiction of conventional cone jet, which is sheared from the base of cone.
Figure 10B:
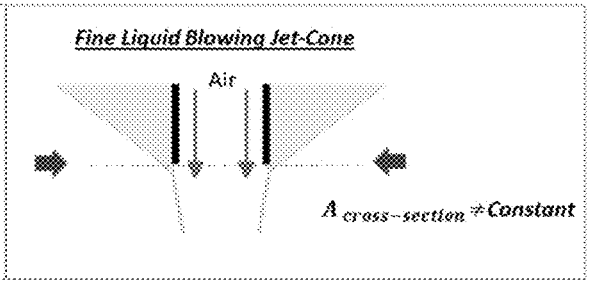
FIG. 10B shows a depiction of fine liquid blowing, showing the momentum transfer away from cone base.

The way the shearing force of the air is applied to the liquid flow in the conventional jet-cone as compared to the present case is depicted in FIG. 10. In the prior art the shearing force is symmetrically applied about the outer side of the rim, which forces the liquid to adhere to the nozzle exit cross-sectional area on the flow's immediate exit from the nozzle (FIG. 10A). This cross-sectional area, where momentum is initially injected into the liquid flow, is thus constant. A constant cross-sectional area, by the law of conservation of mass, dictates that the momentum injected into the liquid flow at this cross-section, by shearing of the air, cannot be used to increase the average velocity. Instead the transferred momentum manifests in a circulation flow, which creates a jet that emanates from a stagnation point. The jet emanating from the circulation flow is thus initiated under low Reynolds number conditions, as depicted in FIG. 10A. That is the cross-section through the stagnation point at the tip of the circulation flow, has zero velocity in the center at the stagnation point, then a velocity profile to the surface determined by the viscous forces, and the applied shear force at the liquid/air interface. As a result, the average polymer jet velocity departing from the tip of the nozzle in melt-blowing, is always approximately zero and coincides to the location where the air velocity is at its maximum. Both the average velocity and the acceleration of the liquid flow increase downstream, from zero values at the initiation of the jets. In fine liquid blowing, however, as depicted in FIG. 10B, the liquid flow cross-sectional area at the point where momentum is initially transferred is dependent on the air flow, and independent of the liquid nozzle's geometry. When the air flow is increased, the cross-sectional area decreases as surface tension is overcome. This allows for increases in average velocity and Reynolds number. Initial average velocity of the polymer jets departing from the tip of the air nozzle are very high compared to the zero value in melt-blowing. The increase of average polymer flow velocity occurs both upstream and downstream of the cross-section where momentum is initially transferred from the air to the liquid.

Thus in conventional fiber production processes like melt blowing and electrospinning, in which a circulation flow develops, jets are initiated at low Reynolds. In fine liquid blowing, however, the jets are initiated at higher Reynolds numbers.

Figure 11:
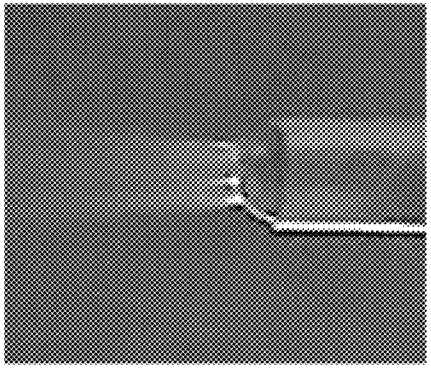
FIG. 11 shows the jetting of 15% wt PVA polymer solution.
Figure 12:
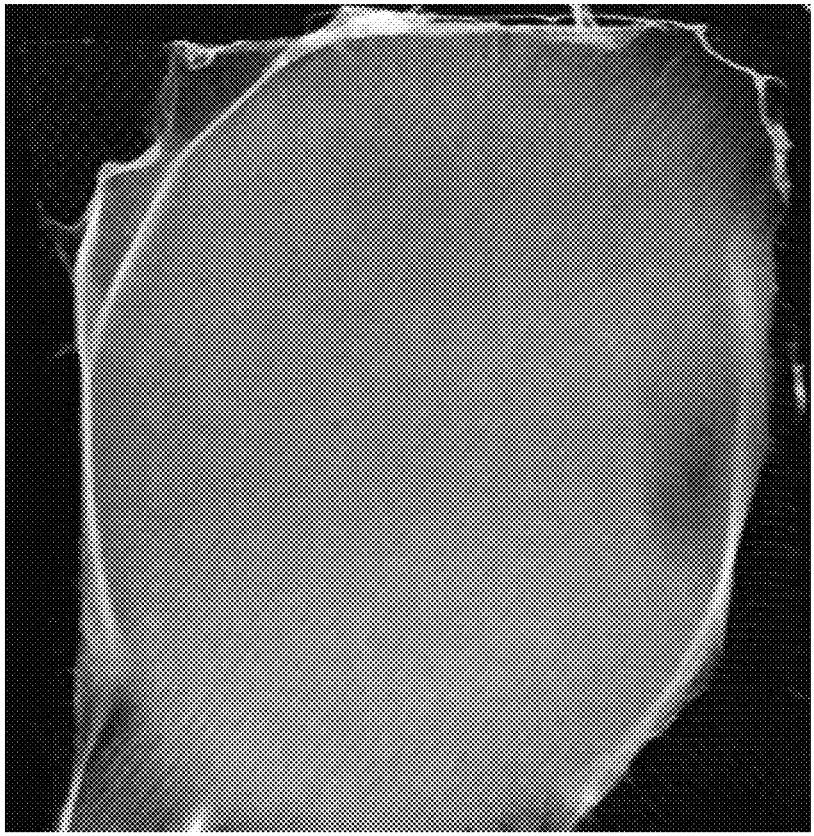
FIG. 12 shows a photograph of PVA nonwoven fiber mat (60 ml/hr) deposited on aluminum mesh.

The fine jets of polymer solution created, as shown in FIG. 11, like in electrospinning and solution blow spinning, induces rapid evaporation of the polymer solution solvent, resulting in fiber solidification and eventual fiber deposition downstream, as shown in FIG. 12, which is a photograph of PVA nonwoven fiber mat (60 ml/hr) deposited on aluminum mesh.

The resulting fiber samples, produced using this process, were collected and imaged using scanning electron microscopy (SEM). The fibers were sputtered with 10 nm of gold as a pre-treatment to increase imaging quality during SEM. While some of the fiber dimensions were determined using the Zeiss Ultra plus FESEM scanning electron microscope and software, the other fibers in these images were analyzed using the Image-J open software to precisely determine their diameter.

Figure 13:
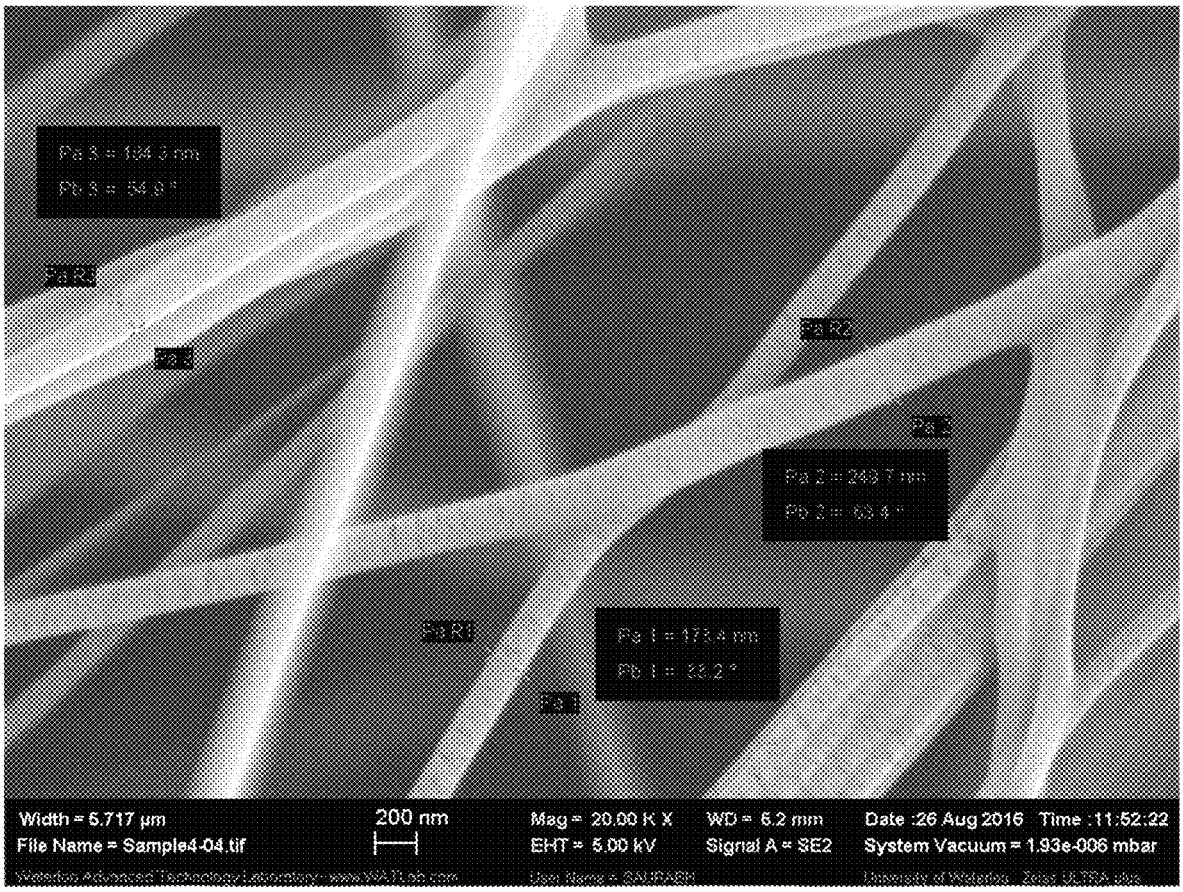
FIG. 13 shows a PVA fiber produced at a solution feed rate of 600 ml/hr.
Figure 14:
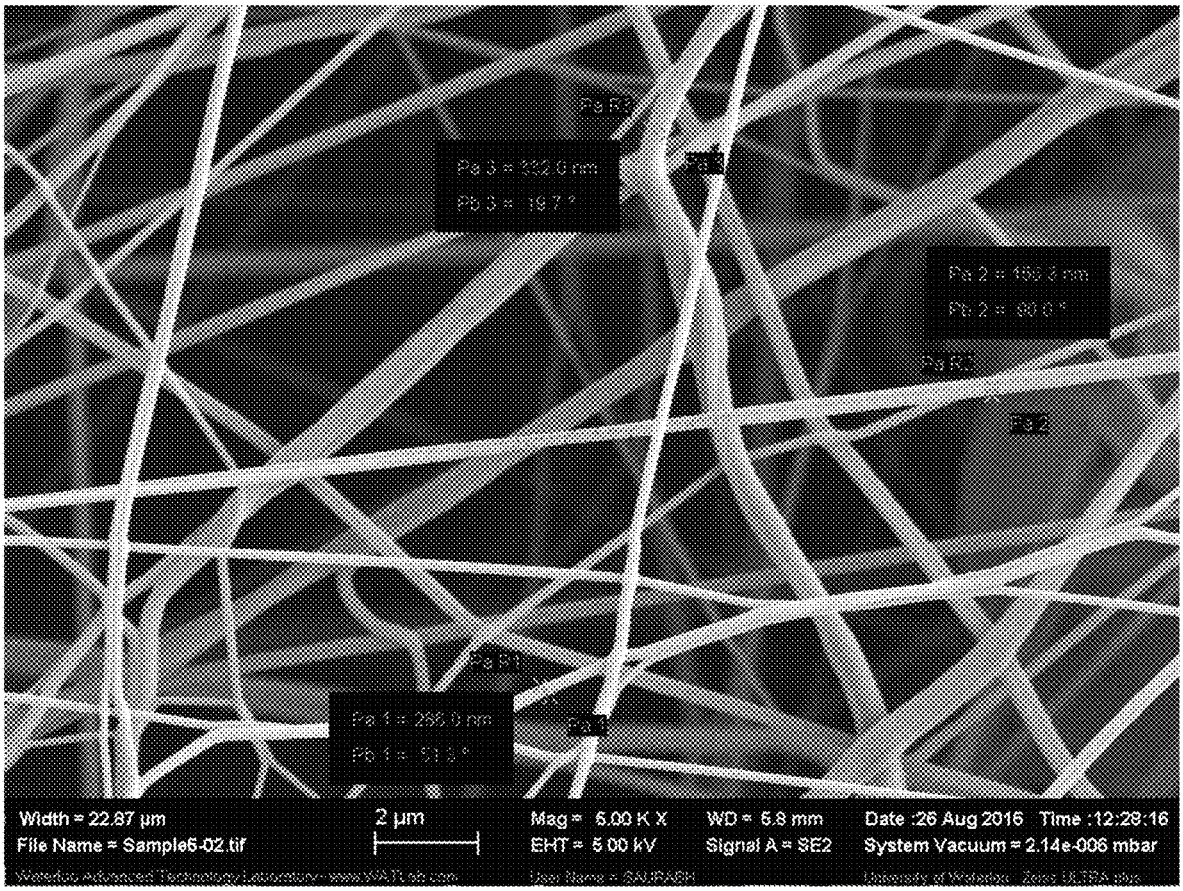
FIG. 14 shows a PVA fiber produced at a solution feed rate of 30 ml/hr.
Figure 15:
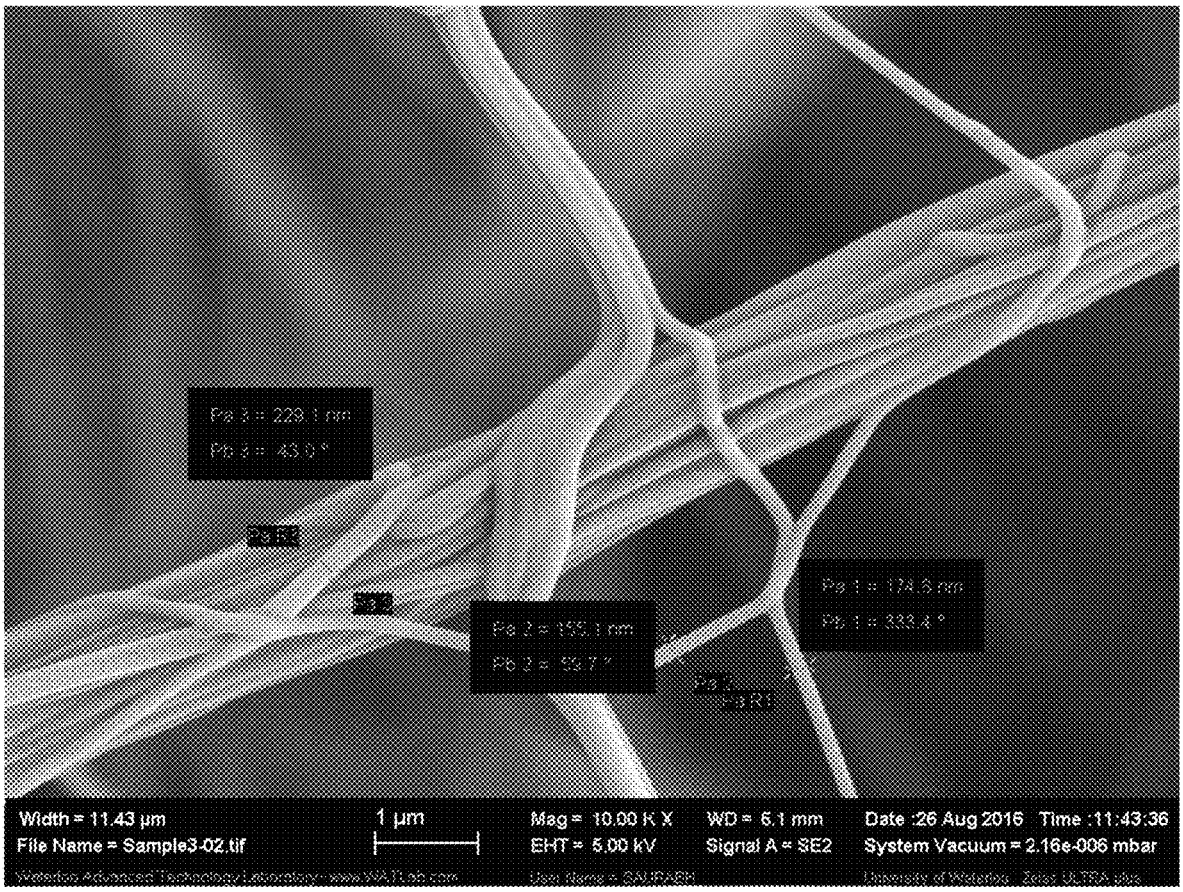
FIG. 15 shows an instance where the fibers coalesce into a bundle 1.5 μm in diameter (300 ml/hr)

The fibers produced in Nano-blowing, display the tendency to adhere to each other. This tendency, seen in FIG. 13 and FIG. 14, is observed at all solution feed rates tested and is present even though the fibers are fully dried when collected. This indicates that the fibers are coming into contact with each other before they dry. It is suspected that the "Flapping" mechanism is causing the fibers to "braid" into the observed bundles. The fibers are believed to come together as they oscillate inwards and outwards about the circumference of the gas nozzle in the "straight jet" stage. In the extreme case, the fibers bundle together in a solid cylinder as shown in FIG. 15. Fiber bundling is also observed in solution-blown nanofibers, but by the introduction of a self-induced electrostatic field, this trend of bundling can be countered to produce separated fibers.

TABLE 2

The ranges of fiber diameter spun at different fine liquid blowing feed rates.

| Process | Polymer | Solvent | Feed Rate (ml/hr) | Fiber Diameter (nm) |
|---|---|---|---|---|
| F L B | 15% wt PVA | Water | 30 | 129-400 |
| | 15% wt PVA | Water | 60 | 90-420 |
| | 15% wt PVA | Water | 300 | 135-355 |
| | 15% wt PVA | Water | 600 | 96-300 |
| | 15% wt PVA | Water | 900 | 132-370 |

Over the test range presented in Table 2, from 30 ml/hr to 900 ml/hr, solution feed rate did not show any particular influence on the fiber diameter produced in nano-blowing. This contrast drastically, to the trend of increasing fiber diameter with increasing volumetric flow rate that is seen in electrospinning. This corroborate the point that the processes are scaling differently. In general, the fibers produced were between 96 nm to 430 nm in diameter. Using equation 1 to estimate the production rate of fiber, and assuming that all the polymer in the solution is used in creating fiber; at 900 ml/hr, 15% polymer concentration, a solution density of 1 g/ml, the production rate is 135 g/hr.

The present nozzle can also be used in an electric or a magnetic field, the use of which are known in the prior art. The addition of an electric field or a magnetic field would provide further opportunity to control and fine tune final fiber mats characteristics such as porosity and fiber laydown orientation.

Another Embodiment of Fine Liquid Blowing (New Matter)

Figure 16:
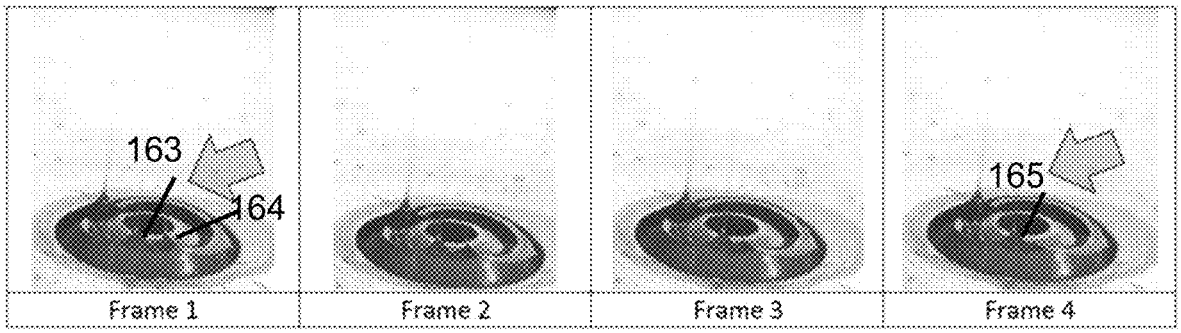
FIG. 16 shows Sequential frames showing an event when two Polyethylene oxide jets collide.

In the presented configuration of fine liquid blowing, it is possible that the collisions of jets cause bundling (see FIG. 15) in the fiber mats. An instance of the collision of two jets (6% polyethylene oxide (PEO)/water) was captured and is shown in FIG. 16. In FIG. 16, originally in frame 1 there are two jets highlighted in the forefront 163, 164, as the frames progress these jets move towards each other until they collide, leaving only one jet 165 from the original two as seen in frame 4.

Figure 17A:
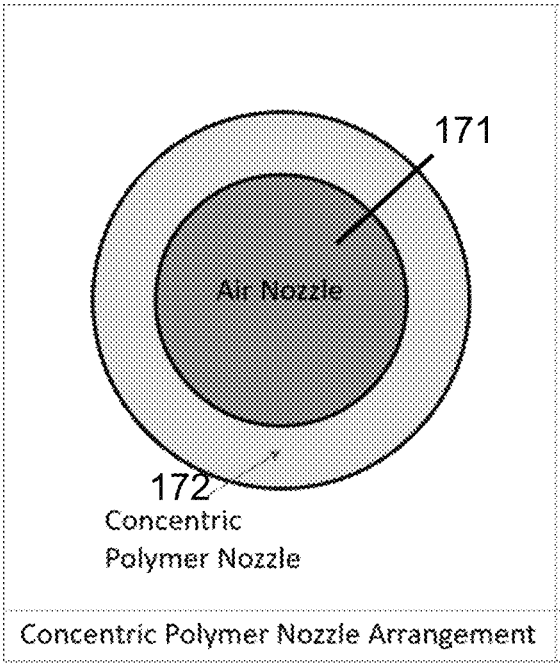
FIG. 17A shows a form of Fine Liquid Blowing, one polymer nozzle is arrange concentrically to the air nozzle.
Figure 17B:
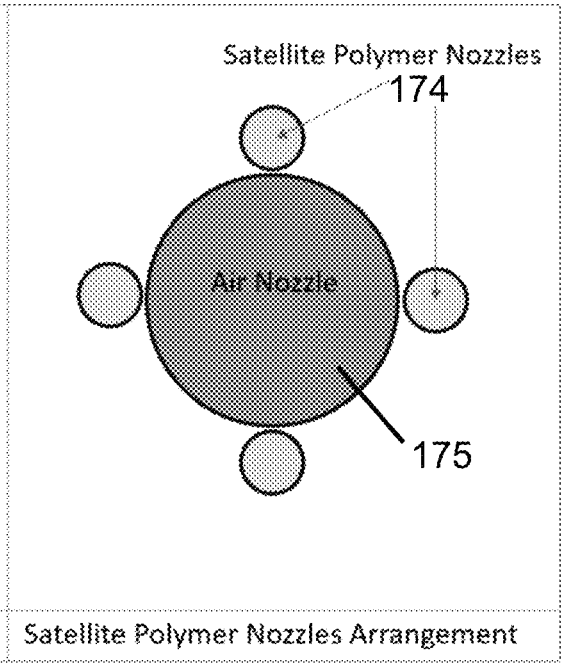
FIG. 17B shows another form of Fine Liquid Blowing, numerous polymer nozzles are arranged around the central air nozzle.

To avoid the drifting of jets towards each other, and their eventual collisions, as in FIG. 16, a non-electrified solution was devised and is presented in this section. The modified arrangement is depicted in FIG. 17B. Instead of a single concentric polymer nozzle 172 around the gas nozzle 171 as depicted in FIG. 17A, several "satellite" polymer nozzles 174 are arranged around the central air nozzle 175. The modified arrangement confines a single jet to each of the satellite polymer nozzle, hence restricting the lateral motion of jets.

Figure 18:
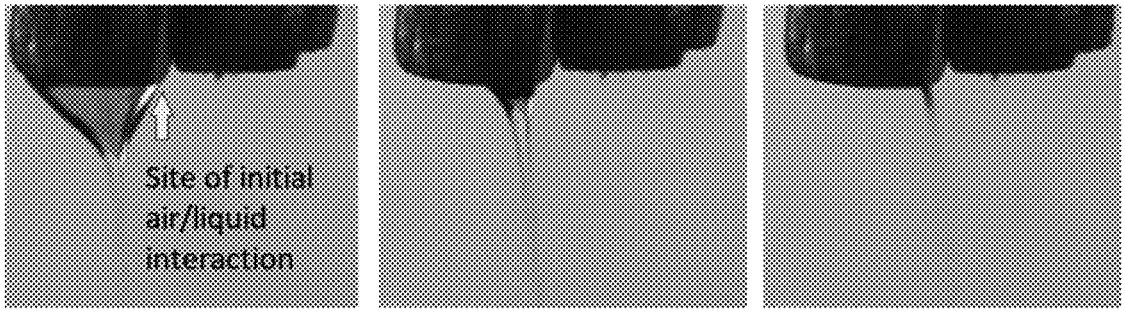
FIG. 18 shows pictures of 1.5 mL/min flow 6% PEO solution being blown by air flow at varying psi. As air flow is increased the radius of the liquid flow at the nozzle exit decreases.

A unit (the air nozzle and a single satellite polymer nozzle) of the modified arrangement is shown in FIG. 18. In this case, a 3.4 mm (gauge 8) diameter nozzle is carrying 6% PEO at a flow rate of 1.5 ml per minute. The nozzles are placed parallel to each other, separated by a small distance.

Figure 19:
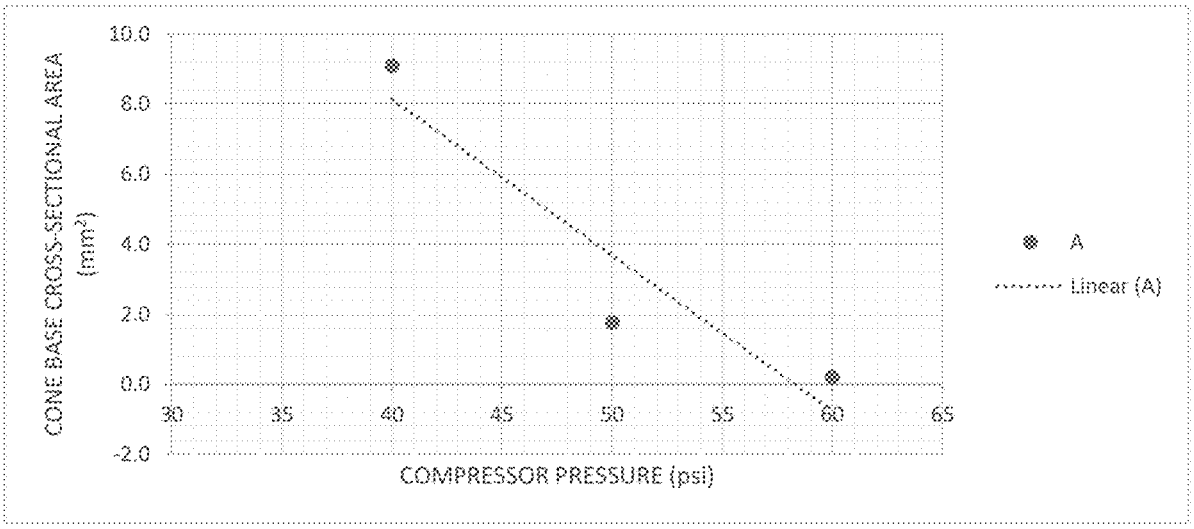
FIG. 19 shows cross-sectional area of flow at liquid nozzle exit vs operating pressure.

The air nozzle is on the right side while the liquid nozzle is on the left. In this case the initial contact between liquid and air flows occurs at the point on the liquid nozzle rim closest to the air nozzle, as indicated in FIG. 18 (40 psi). As the air supply pressure is increased, an unsteady pulsating cone that grows and shrinks is first observe. From 40 psi a steady jetting flow is created. As the pressure is increased further, the diameter of the cone base decreases from 3.4 mm at 40 psi, to 1.5 mm at 50 psi, then to 0.5 mm at 60 psi, as shown in FIG. 19. In this demonstrated case, the cross-sectional area of the polymer flow, immediately, at the exit of the nozzle (the base of the cone in the traditional capillary cone-jet structure is dependent on the high velocity gas flow as shown in FIG. 19, and is independent of the nozzle's diameter.

Through the motion observed from the sequential photos in FIG. 18, it can be observed that the high velocity air, pulls the liquid flow to the right towards the initial point of air/polymer interaction while simultaneously accelerating the polymer jet downstream. It is this pull to the right in this case which overcomes surface tension, which allows the cross-sectional area to decrease and the average velocity of the polymer flow to increase at this section. As in the first design, this results in a jet that is initiated at an elevated Reynolds number.

Figure 20:
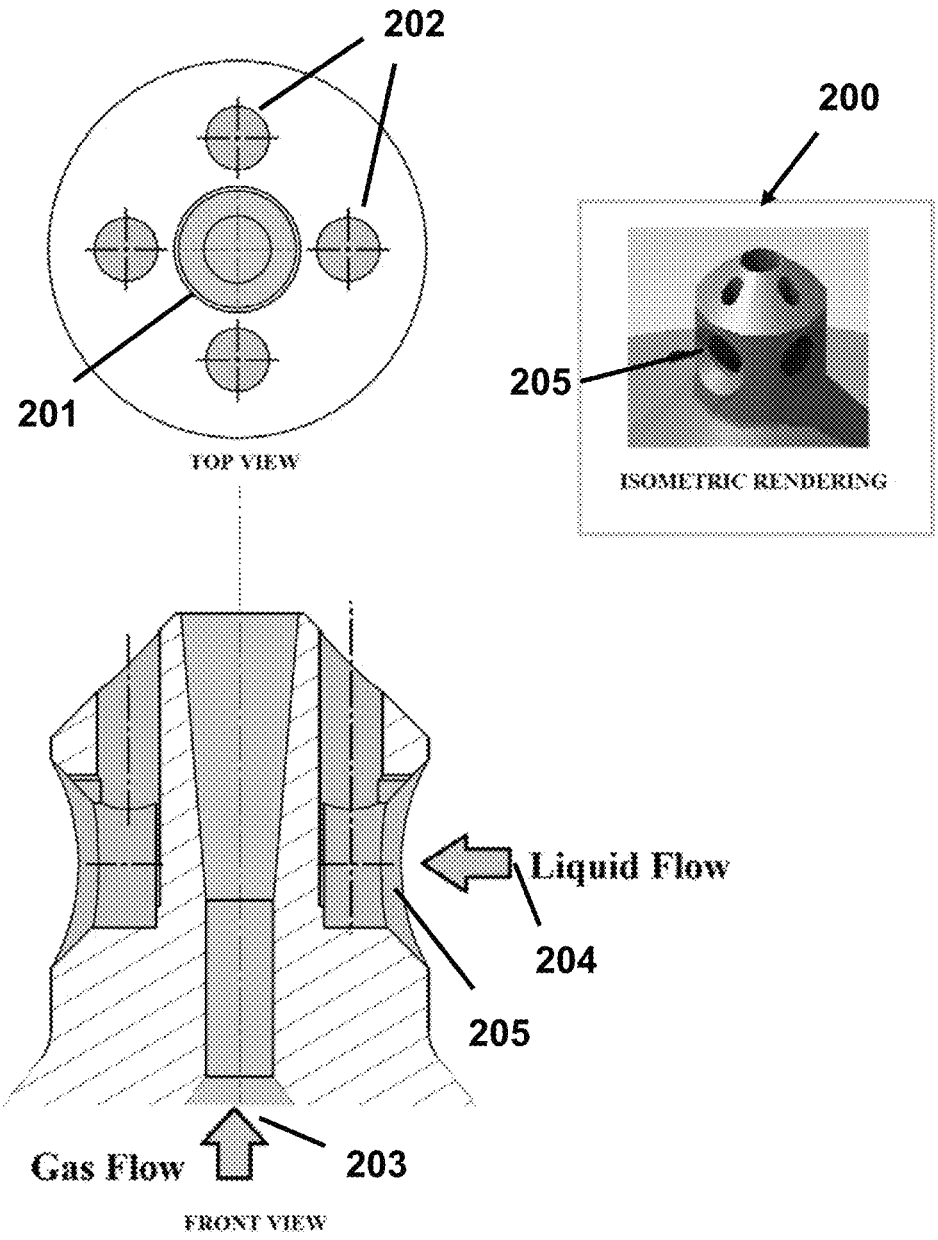
FIG. 20 show photos of a nozzle depicted in FIG. 16, spinning polypropylene jets.
Figure 21:
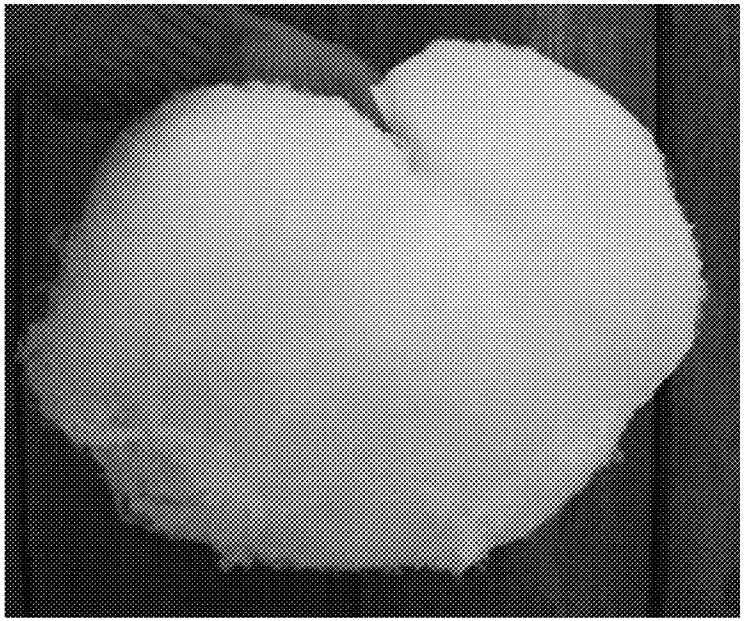
FIG. 21 is a photo of polypropylene fiber deposition.

Polymer Melt Setup and Methodology: In addition to addressing the bundling of fibers (see FIG. 15), the second nozzle is also used to further highlight the difference in the scaling of fine liquid blowing compared to conventional fiber spinning techniques. The second nozzle design 200 as shown in FIG. 20 is used in a melt blowing setup. The nozzle comprises of one core orifice 201 and four satellite orifices 202 constructed at the periphery of the core orifice. The core orifice protrudes outwardly beyond the tip of the satellite orifices. The air flow 203 (or other gases) from a compressor delivered to the nozzle. The gas can be heated before it is delivered to the nozzle. Any suitable heater (such as a T type Omega model AHP-7561 inline heater can be used) can be used to heat the liquid while a polypropylene melt is delivered to the nozzle by an extruder procure from Filastruder. The polypropylene used for the test was the Achieve™ 6035G1, obtained from ExxonMobil. The melt flow 204 is introduced from the satellite orifice inlets 205. The melt index of this polymer brand was 1550. Conventionally, to produce nanofiber in melt blowing, the polymer liquid nozzle must be as fine as 0.125 mm, however the liquid polymer nozzle 202 used in this work is 2 mm in diameter (see FIG. 20), which is up to sixteen (16) times larger than the conventional nozzles used. This significantly reduces the shear losses and reduces the pressure requirements for the flow.

A variety of nozzle sizes can be used. The core orifice diameters can be in a range of 0.5 mm to 5 mm, whereas the individual satellite orifice diameters can be in a range of 0.15 mm to 5 mm. The protrusion distance can be in a range of 0.1 mm to 3 mm.

To produce the polypropylene fiber deposition the compressor was set to 60 psi, the extruder was set to 220° C. and operated at 500 g/hr, while the air delivered to the nozzle was heated to 145° C. The fiber deposit was collected on a mesh 50 cm downstream from the nozzle. The fibers were imaged and the results are presented.

The process, however, can be operated at a wide range of conditions. For instance, the supply gas pressure can be in a range of 10 to 1500 psi, at flow rates ranging from 1 to 6000 SCFM, resulting in exit Mach numbers up to 5, and gas temperature can range from room temperature to 1600 C, and the liquid flow can range from 1 mL/hr to 20 L/hr.

Figure 22A:
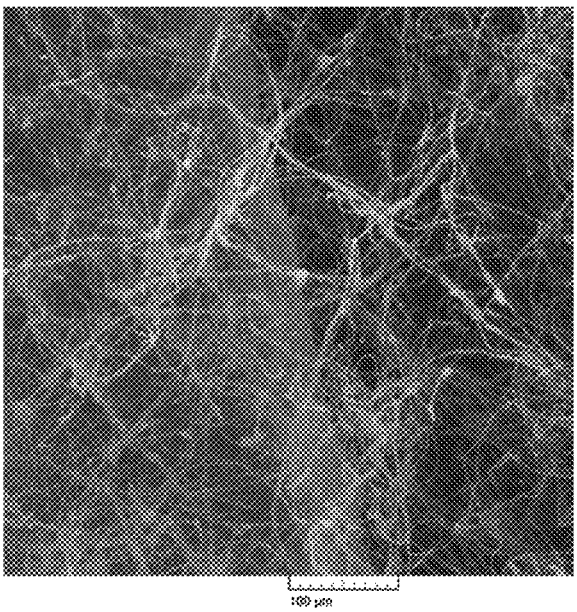
FIG. 22A is SEM image of polypropylene fibers produce.
Figure 22B:
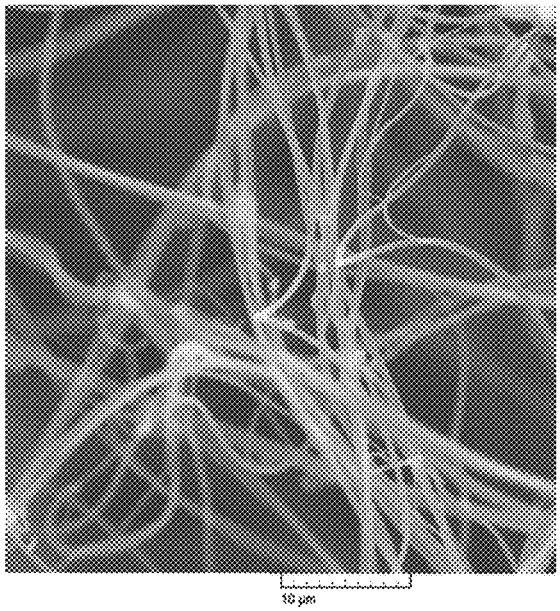
FIG. 22B is SEM image of polypropylene fibers produce.
Figure 23:
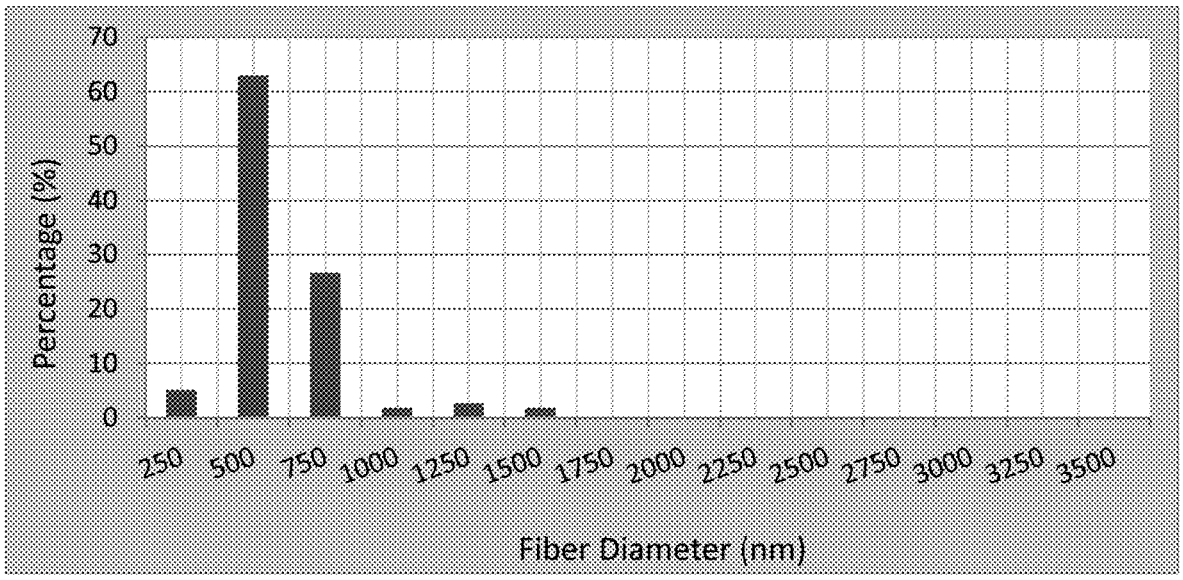
FIG. 23 is a Histogram of fiber diameter spread of the polypropylene fiber deposition.

The SEM images are shown in FIGS. 22A and 22B. Noticeably the fiber deposition in both images in FIGS. 22A and 22B do not show the signature bundling seen in FIGS. 13-15. Using more than one hundred fibers, a histogram of the fiber diameters percentage was done and is presented in FIG. 23. The histogram shows that the majority of the fibers produced (greater than 90%) were less than 1000 nm, while a small minority of the fibers (less than 10%) were above 1000 nm. These results illustrate two points. Firstly, the second design remedies the characteristic bundling seen in the fiber mats of the first design, and secondly, the scaling in fine liquid blowing is such that fibers less than 1000 nm can be produced from 2 mm diameter nozzles, which is significantly larger than those used to produce nanofiber mats in conventional melt blowing systems.

Figure 24:
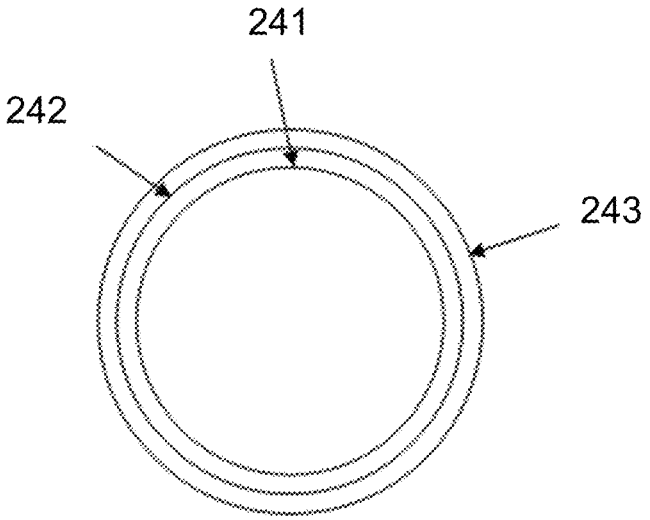
FIG. 24 is a plan view of a concentric needle system.

Another embodiment of the same nozzle concept is presented in FIG. 24. In this case, there are more than two concentric needles. Gas comes out in between needles 240 and 242, and the liquid comes out in between needles 242 and 243. In this design, the annulus gap width and protrusion distance are kept at required levels to obtain the desired fibers, while the flow cross sectional area is increased to increase the production rates. In this case, the needle diameters can further increase as well.

Any fiber producing melts or solutions can be used in the present system. For example, some of the liquid polymers suitable for this process include polyethylene and polypropylene, polycaprolactone, co-polymers of polyethylene-acrylic acid, polyacrylonitrile, polyamides, polybutadiene, polycarbonate, polychloroprene, polychlorotrifluoroethylene, poly(ethylene terephthalate), polyesters of various compositions, polyisoprene, poly(methyl methacrylate), polyoxymethylene, poly(phenylene oxide), polystyrene, polysulfones, polytetrafluoroethylene, poly(vinyl acetate), poly(vinyl chloride), poly(vinylidene chloride), and/or poly (vinylidene fluoride), as well as co-polymers, polymer blends, or adhesives (e.g., ethylene-vinyl acetate) of all sorts.

In some compositions, other compounds (e.g., viscosity reducing additives, conductive additives, etc.) can be added to the composition. For a polymer, some viscosity reducing additives could include generally anything that decreases the molecular weight of the polymer chains in a polymer melt, or lubricants In addition, the base compound may not be a polymer. For instance, the base compound can be another suitable compound that can liquefy and which can be spun, or in some cases even a solvent based system in which the solvent either evaporates or is separated during the spinning process.

In some cases, suitable base compounds can include molten glasses, molten metals, molten salts, minerals, ceramics, and pure liquid substances. Other base compounds could include mixtures, including polymer mixtures, as well as suspensions, emulsions, and solutions.

In addition, additional compounds may be added as the particles are collected to provide a desired distribution of particles therein. These materials could include various types of performance enhancing materials, such as for example carbon, activated carbon, super absorbent polymers, zeolites, clays such as bentonite or kaolin, diatomaceous earth, chopped fibers, ion exchange resins, Teflon powder, adsorbents, absorbents, silicates, aluminas, minerals, ceramics, glass, polymer powders, beads, granules, and more generally powders of all kinds.

In another embodiment of the same invention, an electric field, magnetic field, and/or an electromagnetic field may be applied between the nozzle(s) and the collecting surface to further attenuate the fibers as well as control the fiber laydown and fiber morphology.

This nozzle can also be used to produce particles (e.g., spray, coating, aerosol) both in micro and nano size that is defined singular form that have at least one dimension in nano or micro scale. For example: particles have three dimensions in the nano/micro scale; fibers and tubes have two dimensions in the nano/micro scale; and plates and flakes have one dimension that is in the nano/micro scale. Thus, for example, a nano flake can be measured on the nanoscale in only one dimension, and a micro particle can be measured on the micro scale in all three spatial dimensions.

What is claimed is:

1. A method of forming micro and nano size fibers from a polymer solution or a polymer melt, comprising the steps of:

a) constructing a composite nozzle comprising of a core orifice having a core-tip, and at least one satellite orifice, external to the core orifice, having a satellite-tip, wherein the core-tip extends outwardly beyond the satellite-tip forming a protrusion distance;

b) supplying the polymer solution or the polymer melt at a liquid flow rate into the at least one satellite orifice to form a liquid capillary surface between the satellite-tip and the core-tip;

c) supplying a gas at a gas flow rate through the core orifice, wherein the gas is selected from the group consisting of nitrogen, argon, oxygen, butane, helium, argon, carbon dioxide, fluorocarbons, fluorochlorocarbons, and mixtures thereof, and d) adjusting the liquid flow rate and the gas flow rate to create a plurality of liquid jets at the liquid capillary surface, wherein the liquid flow rate is in a range of 500 mL/hr to 20 L/hr, e) wherein the polymer solution has a polymer concentration in the range of 0.1% to 70% by weight, whereby the plurality of liquid jets is accelerated by the gas stream to form micro and nano size fibers.

2. The method of claim 1, further configuring the gas flow rate to produce fibers having a diameter ranging from 10 nanometers to 50 microns.

3. The method of claim 1, further configuring the gas flow rate to have a gas stream velocity in range of 1 to 5 times a speed of sound.

4. The method of claim 1, wherein the gas flow rate has a pressure in a range of 70 kPa to about 10 MPa.

5. The method of claim 1, further having an electric or a magnetic field added a downstream of the composite nozzle to further control a fiber production.

6. The method of claim 1, further collecting a plurality of nanofibers on a collection surface located at a distance between 25 and 150 cm from the tip of the core orifice to form a nonwoven fiber mat.

7. The method of claim 1, wherein the polymer solution or the polymer melt comprises of a polymer selected from the group consisting of poly(lactic acid), poly(methyl methacrylate), poly(vinyl chloride), poly(vinyl alcohol), polystyrene, polyaniline, silk protein, gelatin, collagen, chitosan, poly(ethylene oxide), polycaprolactones, polyamides, polyacrylonitrile, poly(ethylene terephthalate), poly(vinyl pyrrolidone), polyurethanes, natural and synthetic rubbers, or their compounds derivatives thereof.

* * * * *